US006131207A

United States Patent [19]

Basson et al.

[11] Patent Number: 6,131,207

[45] Date of Patent: Oct. 17, 2000

[54] HELMET HAVING RESILIENT BENDING MEANS IN THE LOWER REAR PORTION OF THE SHELL THEREOF

[75] Inventors: Gilles Basson, Châtillon-sur-Chalaronne; Jean-Paul Noyerie, Abergement Clemencia, both of France

[73] Assignee: Gallet S.A., Chatillon-sur-Chalaronne, France

[21] Appl. No.: 08/860,465

[22] PCT Filed: Dec. 29, 1995

[86] PCT No.: PCT/FR95/01759

§ 371 Date: Aug. 12, 1997

§ 102(e) Date: Aug. 12, 1997

[87] PCT Pub. No.: WO96/21370

PCT Pub. Date: Jul. 18, 1996

[30] Foreign Application Priority Data

Jan. 9, 1995 [FR] France ..... 95 00338

[51] Int. Cl.[7] ..... A42B 3/00

[52] U.S. Cl. ..... 2/410; 2/417

[58] Field of Search ..... 2/410, 411, 414, 2/415, 417, 418, 419, 420, 425

[56] References Cited

U.S. PATENT DOCUMENTS

| | | | |
|---|---|---|---|
| 1,660,375 | 2/1928 | Dieterle . | |
| 3,107,356 | 10/1963 | Perstronk et al. . | |
| 3,197,784 | 8/1965 | Carlisle | 2/420 |
| 3,230,544 | 1/1966 | Mager . | |
| 3,591,863 | 7/1971 | Rickard . | |
| 3,720,955 | 3/1973 | Rawlings . | |
| 4,279,038 | 7/1981 | Bruckner et al. | 2/425 |
| 4,282,610 | 8/1981 | Steigerwald et al. | 2/414 |
| 4,477,929 | 10/1984 | Mattsson | 2/425 |
| 5,165,116 | 11/1992 | Simpson | 2/424 |
| 5,271,103 | 12/1993 | Darnell | 2/418 |
| 5,666,670 | 9/1997 | Ryan et al. | 2/425 |

FOREIGN PATENT DOCUMENTS

| | | |
|---|---|---|
| 1214865 | 4/1960 | France . |
| 1060567 | 3/1967 | United Kingdom . |
| 2202729 | 10/1988 | United Kingdom . |

*Primary Examiner*—Michael A. Neas
*Attorney, Agent, or Firm*—Greenblum & Bernstein, P.L.C.

[57] ABSTRACT

A protective helmet (1) including a main outer shell (2) consisting of a wall (5) with a front facial opening (3). The lower rear portion (8) of the wall (5) includes resilient bending means (13, 14*a,* 14*b,* 14'*a,* 14'*b*).

22 Claims, 7 Drawing Sheets

HELMET HAVING RESILIENT BENDING MEANS IN THE LOWER REAR PORTION OF THE SHELL THEREOF

The present invention is related to an improvement to a helmet, and more specifically a helmet whose outer shell includes resilient bending means in its lower rear portion. The helmet is more especially adapted to be worn by aircraft and helicopter pilots, but non exclusively, since the invention can be used for any type of helmet.

Protective helmets are already known which are used in various fields and are worn by diverse users, such as cyclists, motorcyclists, firemen, skiers and others, such as aircraft and helicopter pilots. All of the current helmets, irrespective of their use, include a generally sphere-shaped rigid outer shell including a facial opening, and whose cavity thus formed includes protective and comfort padding elements adapted to nest the user's head.

For each type of utilization, manufacturers have attempted to design helmets having a specific configuration. But although many improvements have thus; been envisioned, developed and implemented, all has not been accomplished. Indeed, the general comfort of the current helmets is fairly satisfactory as a whole, but it must be noted that the comfort of the helmet at the level of the user's nape leaves a lot to be desired, in spite of the presence in most current helmets of padding made of flexible material, or of a strip arranged within the rear portion of the shell, fairly complex and costly adjusting means then being provided so that the padding or the strap can be adapted to the size and shape of the user's nape.

The object of the present invention is to eliminate the drawbacks of the current devices and systems for the holding and comfort of the nape and proposes a new helmet in which the rear portion of the shell includes particularly simple resilient adaptation means. The adaptation to the user's nape occurs automatically, thereby providing, it with a comfort which had not been achieved to date.

Thus, the protective helmet according to the invention is of the type including a main outer shell constituted by a wall having a front facial opening, and is characterized in that the lower rear portion of the wall includes resilient bending means, the main outer shell being made of a deformable material.

According to complementary characteristics, the wall of the outer shell is made of plastic, or of a composite material of the type constituted, for example, by at least one layer of glass fibers and/or carbon fibers and/or aramid fibers or the like, impregnated with a thermoplastic or thermohardening resin.

The main outer shell of the helmet of the invention includes a plurality of wall portions, namely, an upper front wall portion extended rearwardly by an upper rear wall portion, which is itself extended downwardly by a lower rear wall portion limited downwardly by a lower edge, said lower rear wall portion including at least one notch opening which advantageously opens downwardly on the lower edge.

According to various embodiments, the lower rear wall portion includes two, three, four, or more slit-shaped lateral cutouts.

In a preferred arrangement, the protective helmet includes a nape cushion that is partially retained in the shell by the cutouts of the wall.

Other characteristics and advantages of the invention will become apparent from the description that follows, with reference to the annexed drawings which are only provided by way of non-limiting examples.

FIG. 8 is a perspective rear view, whereas

Figure 1:
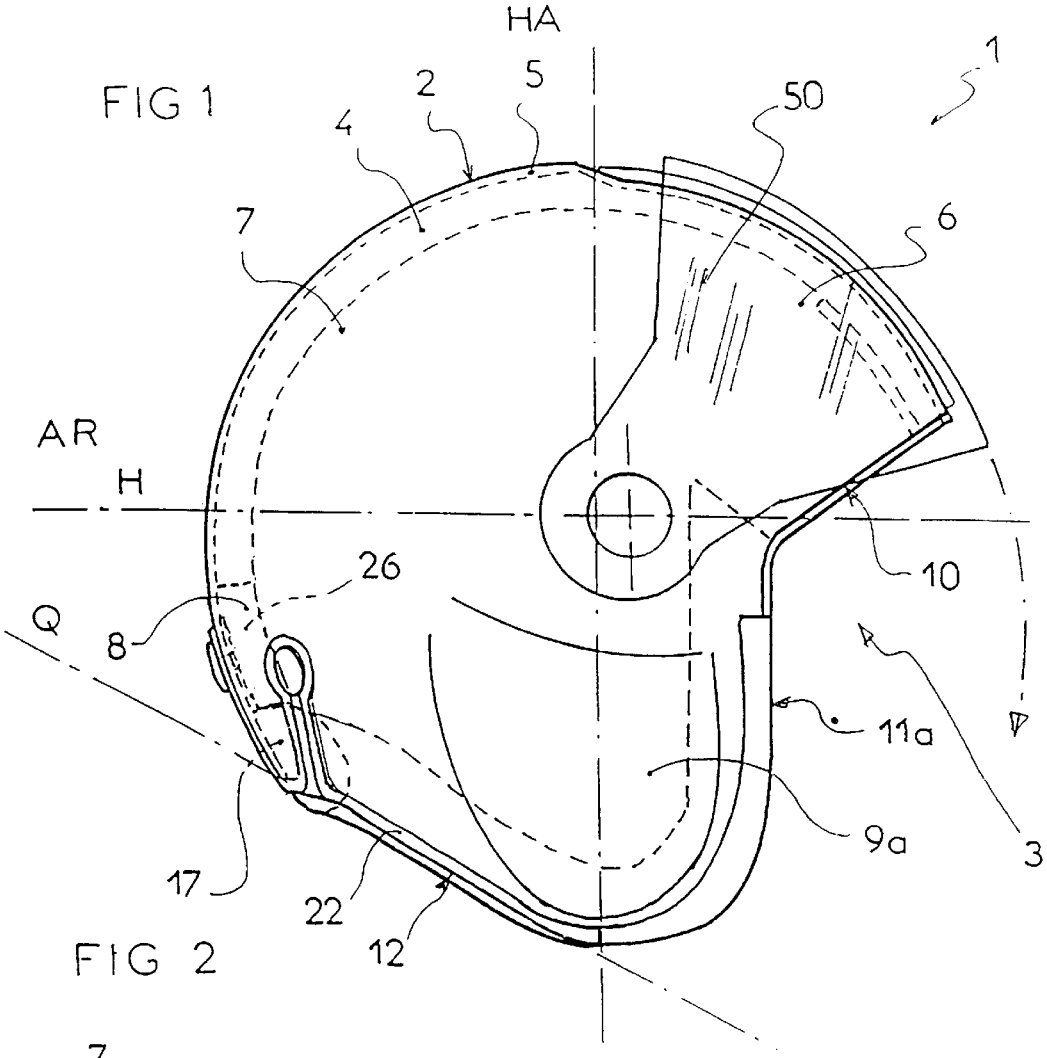
FIG. 1 is an external lateral view of a helmet according to the invention.
Figure 2:
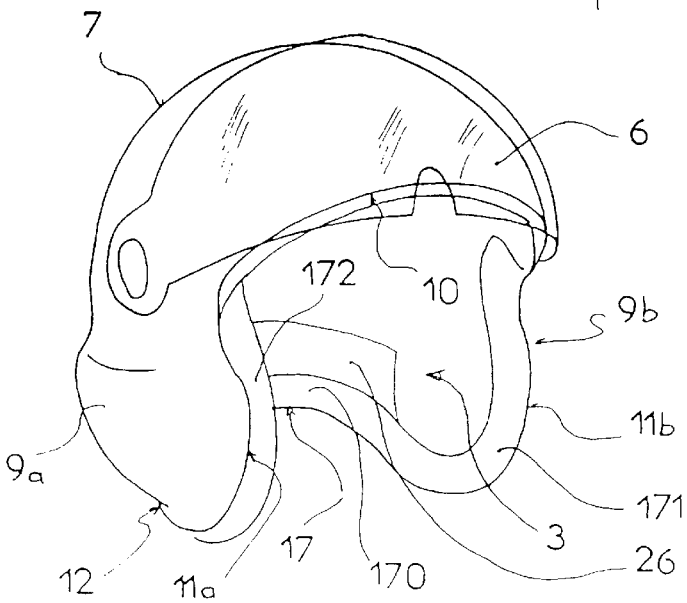
FIG. 2 is a front perspective view of the helmet.
Figure 3:
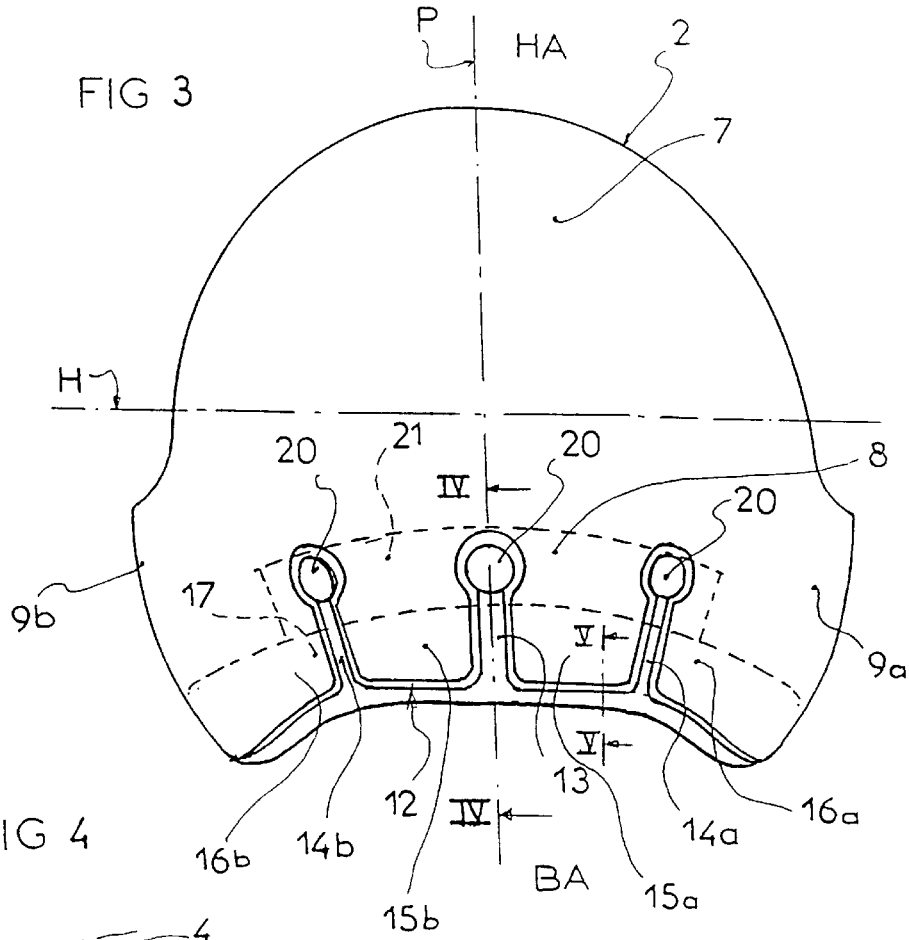
FIG. 3 is a rear view more particularly showing the invention.
Figure 4:
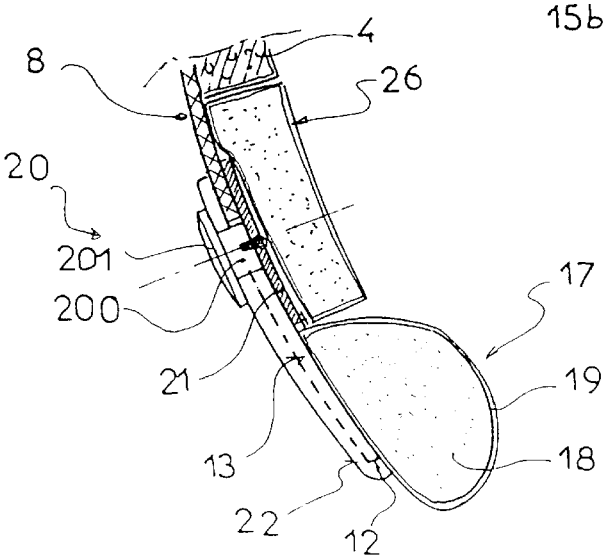
FIG. 4 is a partial cross-sectional view along IV—IV of FIG. 3, but on a larger scale, showing how the fastening of the nape cushion is carried out.
Figure 5:
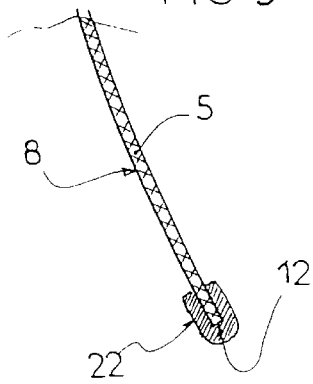
FIG. 5 is a partial cross-sectional view along V—V of FIG. 3, illustrating how the finish of the lower edge of the helmet is obtained.
Figure 6:
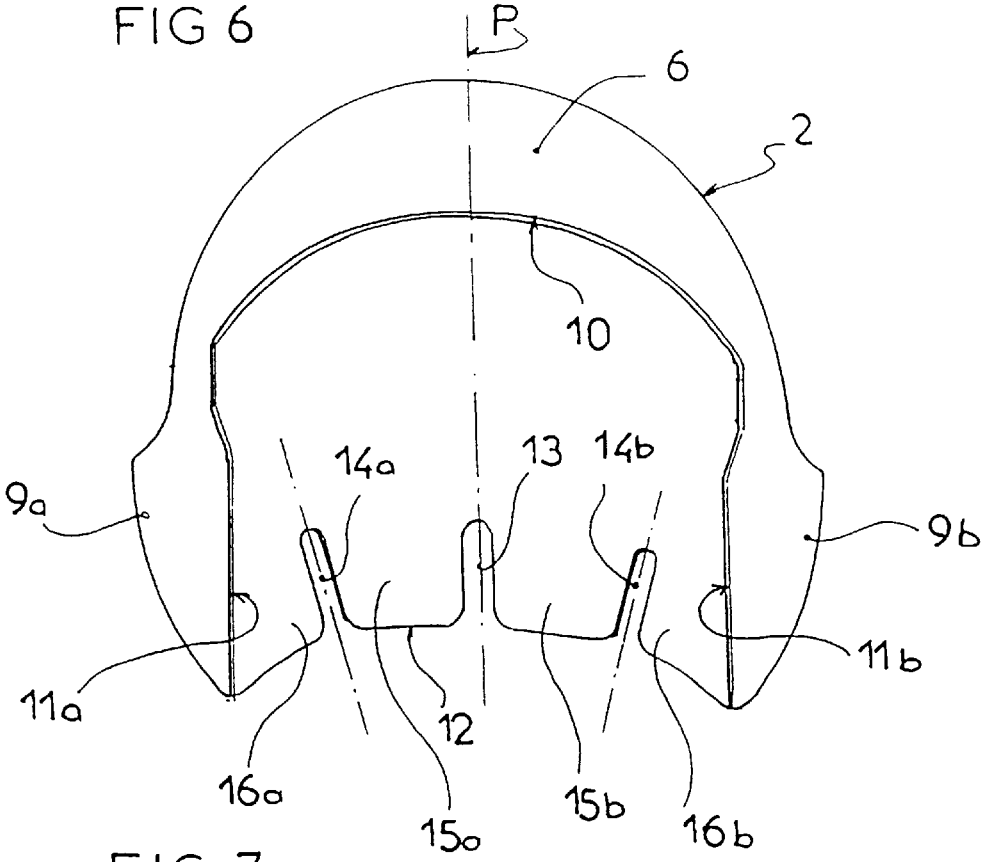
FIGS. 6 and 7 show the shell alone, in a front view (FIG. 6) and in a rear view (FIG. 7)
Figure 7:
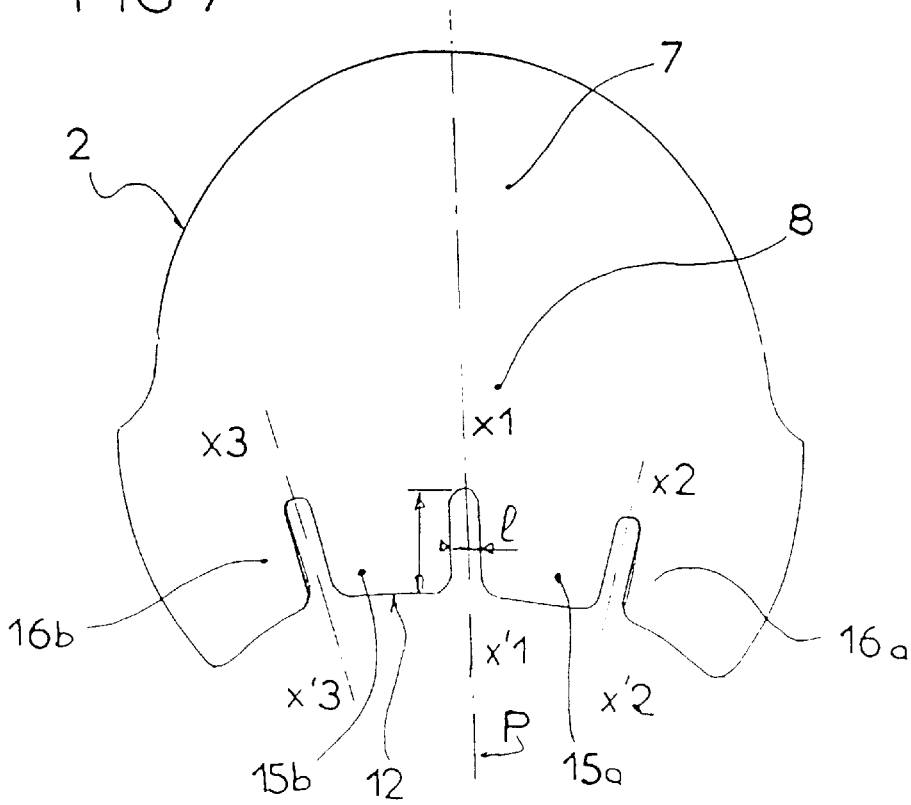
Figure 8:
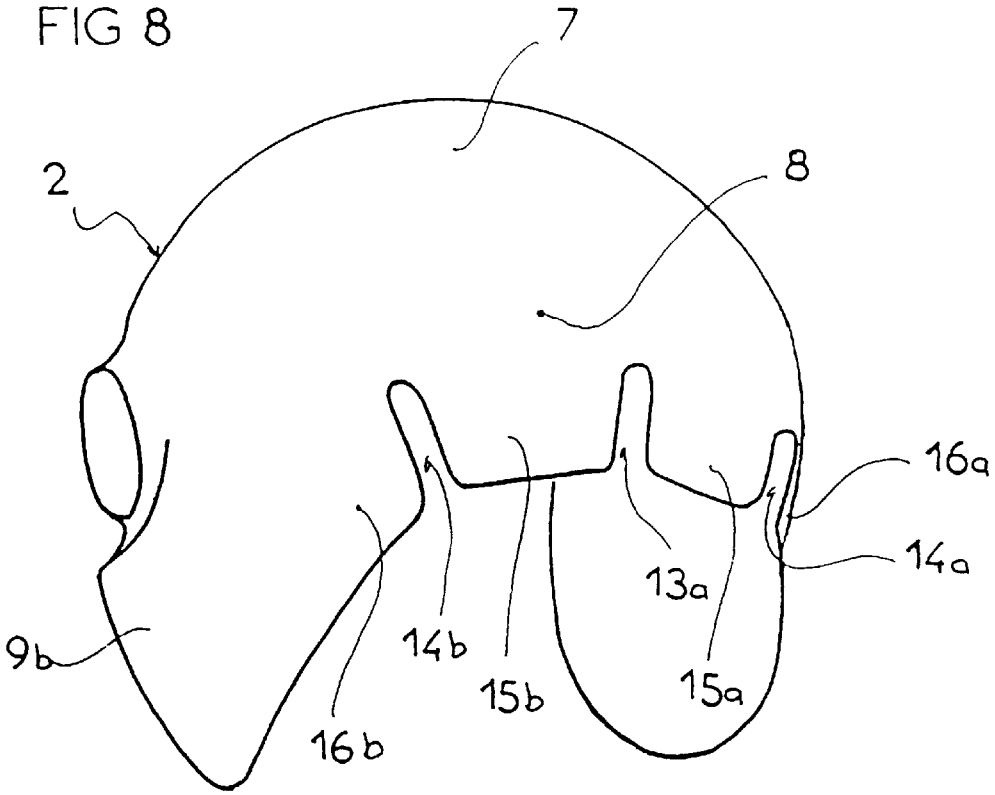
Figure 9:
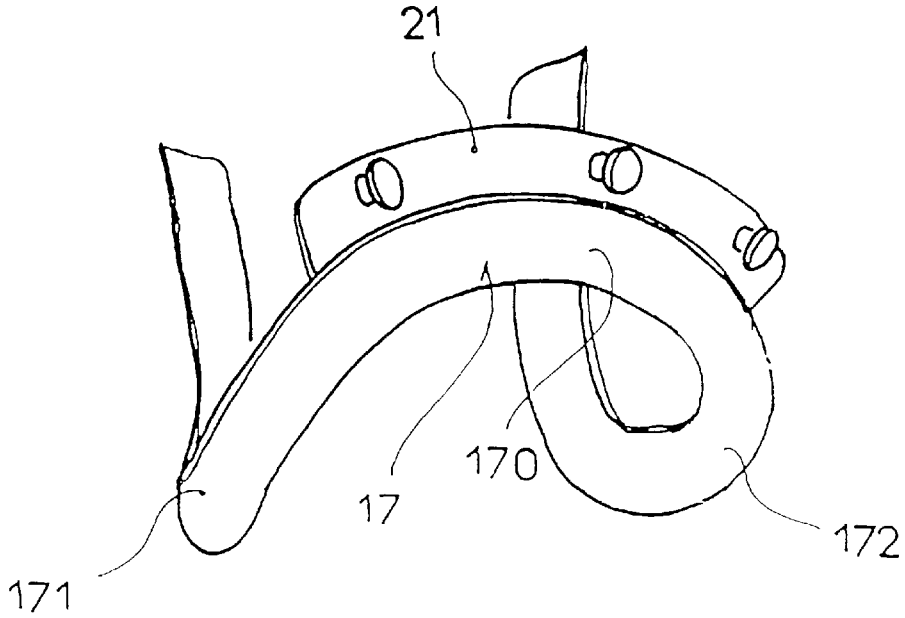
FIG. 9 shows the nape cushion with its fastening means in the same conditions.
Figure 10:
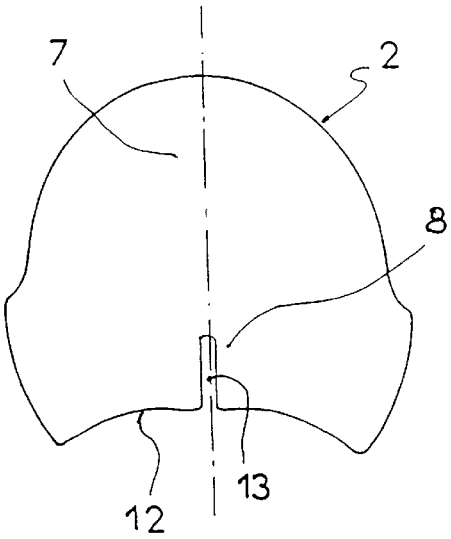
FIGS. 10–18 are rear views similar to FIG. 7 schematically showing, on another scale, nine possible alternative embodiments provided by way of examples.
Figure 19A:
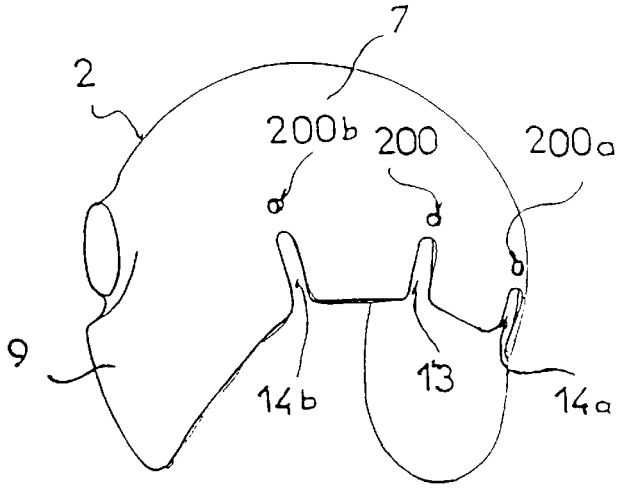
Figure 19B:
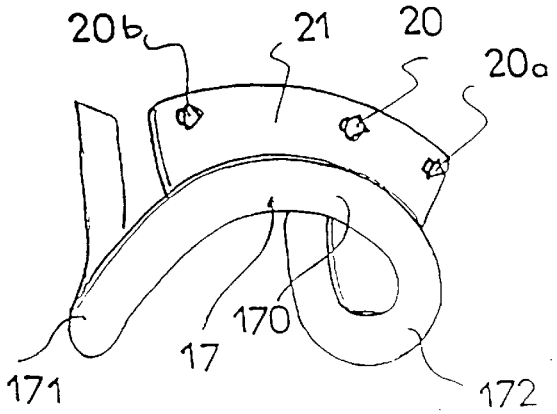

FIGS. 19*a*, 19*b*, are views similar to FIGS. 8 and 9 illustrating an alternative embodiment.

Figure 20:
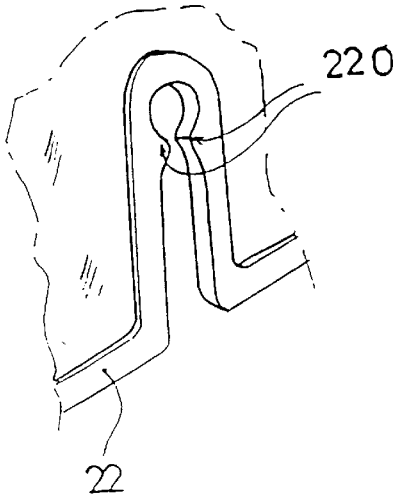
Figure 21:
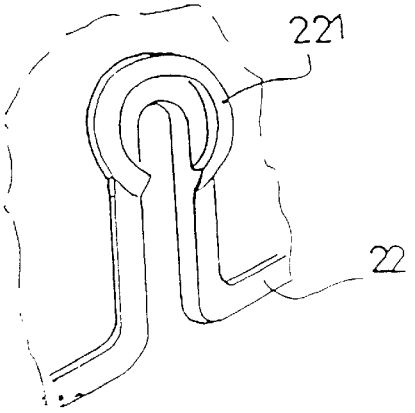

FIGS. 20 and 21 are partial schematic views showing how the nape cushion could also be held.

Let's note that to simplify the drawings, the chin strap of the helmet provided by way of example, which is in fact well known in itself and can be of any type, has voluntarily not been shown.

The protective helmet shown by way of example in FIGS. 1–9, generally designated by the reference (1) is especially a helmet for an aircraft pilot, which has a longitudinal general plane of symmetry (P) which includes, in a known manner, a main outer shell (2) having a front facial opening (3) with an internal padding commonly referred to as the upper part (4).

The main outer shell (2) is constituted by a substantially spherical wall (5) with a generally vertical plane of symmetry (P) that is advantageously made of a composite material including a stacking of layers of reinforcing fibers impregnated and connected to one another by a resin matrix. The fibers can be glass, aramid, Nylon, polyethylene or carbon fibers, while the matrix can be a thermohardenable or thermoplastic type of resin.

The main outer shell (2) includes a plurality of wall portions, namely, an upper front wall portion (6) extended rearwardly by an upper rear wall portion (7), which is itself extended downwardly by a lower rear wall portion (8), and further includes two lateral wall portions (9*a*, 9*b*). The upper front wall portion (6) corresponds to the zone occupied by the forehead of the user and is limited by the upper edge (10) of the facial opening (3) which, in turn, is limited laterally by two lateral edges (11*a*, 11*b*). The upper rear wall portion (7) corresponds to the zone occupied by the skull of the user, whereas the lower rear wall portion (8) corresponds to the zone occupied by the nape of the user. In addition, the wall (5) of the upper part is limited downwardly by a lower edge (12) extending in a general plane (Q) inclined with respect to the horizontal plane (H) to extend toward the rear (AR) and toward the top (HA). The lateral wall portions (9*a*, 9*b*) correspond to the zones occupied by the ears of the user and are limited forwardly by the corresponding lateral edge (11*a*, 11*b*) of the facial opening (3) and downwardly by the front ends of the lower edge (12).

According to the invention, the lower rear wall portion (8) of the outer shell limited downwardly by the lower edge (12) includes resilient bending means which enable an accurate adjustment and a wearing comfort for the helmet in the zone of the user's nape.

In the embodiment illustrated in FIGS. 1–9, and provided by way of example, the lower rear portion of the shell thus includes openings or cutouts (13, 14*a*, 14*b*) which advantageously open toward the bottom (BA) on the lower edge (12). According to the embodiment illustrated in FIGS. 1–9, three openings or cutouts (13, 14*a*, 14*b*) are provided which have the form of open slits on the lower edge to create two deformable tongues (15*a*, 15*b*) and two deformable lateral wall pieces (16*a*, 16*b*). The lower edge (12) therefore includes thee longitudinal notches (13, 14*a*, 14*b*), one central cutout (13) and two lateral cutouts (14*a*, 14*b*), providing flexibility to the wall of the helmet in the area where the openings are located, i.e., at the rear lower wall (8). Let's note that the axes of general symmetry (X1-X'1, X2-X'2, X3-X'3) of the three slits (13, 14*a*, 14*b*) extend toward the top (HA) and advantageously perpendicularly to the lower edge (12) along a length (L).

According to a particular arrangement, the helmet includes a peripheral nape cushion (17) arranged within the shell at the level of the lower edge (12). This nape cushion (17) is constituted by a foam padding (18) wrapped in a fabric covering (19). According to a preferred construction, the nape cushion (17) is held in the shell, at least partially, by the bending notches (13, 14*a*, 14*b*). To this end, projections (20, 20*a*, 20*b*) affixed to the nape cushion (17) are provided and are adapted to cooperate with the corresponding notches (13, 14*a*, 14*b*) to be held therein. Thus, the nape cushion (17) is, for example, extended upwardly by a flexible retaining wall (21) on which the three fastening projections (20, 20A, 20*b*) are fixed, each including a cylindrical portion (200) whose end includes a retaining flange (201), as can be seen more particularly in FIGS. 4 and 9.

Let's note also that the central portion (170) of the nape cushion (17) is advantageously extended laterally toward the front by lateral extensions (171, 172) that are fixed within the shell in order to be attached to the inner surface located at the level of the lower edge (12) and to the lateral edges (11*a*, 11*b*) of the facial opening. The fixing of the lateral extensions (171, 172) can be carried out by any means, such as gluing, fastening by self-gripping band, clipping or the like.

To provide the helmet with a better appearance and overall Finish, a finishing portion(22) visible more particularly in FIGS. 1, 3, 4 and 5, is provided. Said finishing portion (22) is U-shaped and made of a flexible plastic material and is nested on the lower edge (12), while ensuring continuity with the edge of the three slits (13, 14*a*, 14*b*).

Furthermore, the inner lining of the shell (2) is constituted by an upper part (4), for example, made of a rigid foam covered with a layer of comfort flexible foam and of a fabric which ensures the internal decoration of the helmet. Let's note also the rear portion of the upper part is extended by a rear comfort band (26) made of a flexible foam and under which the retaining wall (21) of the nape cushion is engaged, as appears more particularly in FIG. 4.

Figure 11:
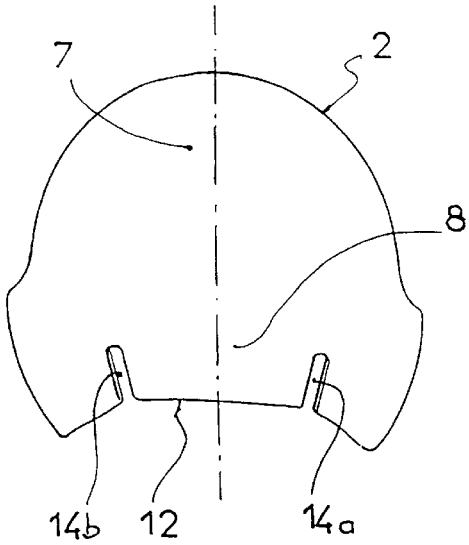
Figure 12:
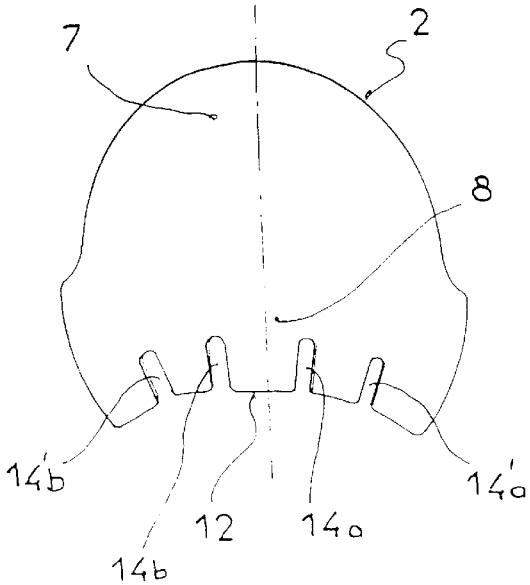
Figure 13:
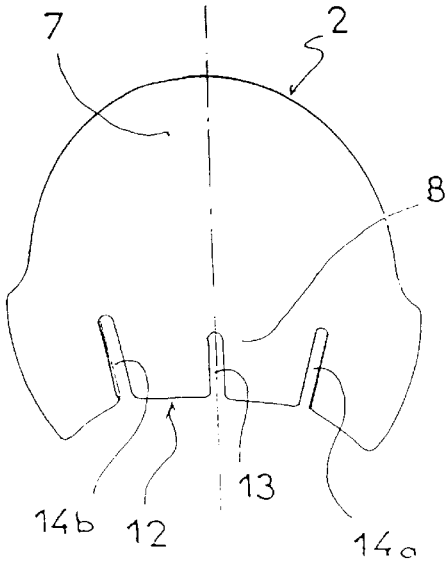
Figure 14:
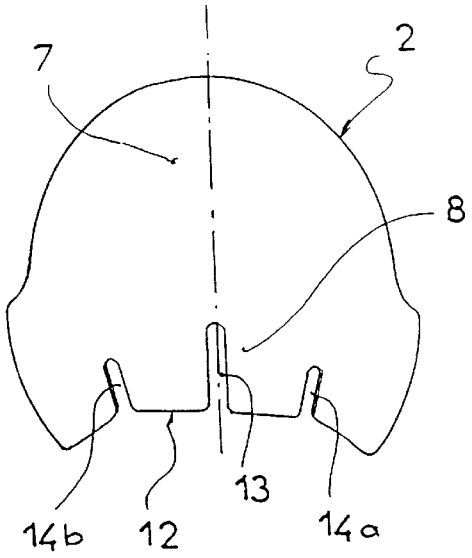
Figure 15:
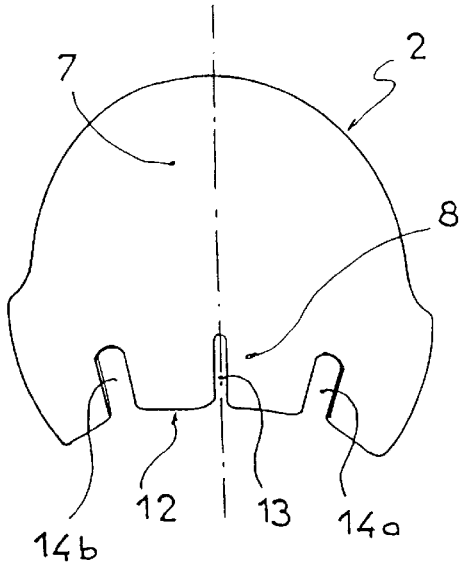
Figure 16:
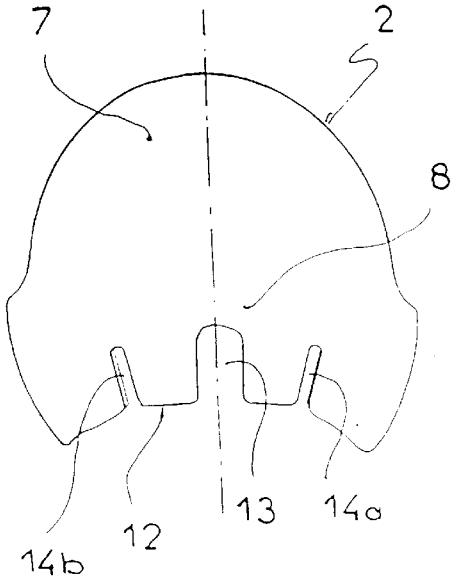

According to the embodiment shown by way of example, the cutouts (13, 14*a*, 14*b*) made in the wall (5) of the lower rear portion (8) of the shell (2) are three in number and have the same length and the same width, but, of course, it could be otherwise and, for example, there could be only one slit (13) as is illustrated in Figure (10), or two cutouts (14*a*, 14*b*), as illustrated in FIG. 11. Of course, there could be more than three cutouts, according to the embodiment of FIG. 12 where four cutouts (14*a*, 14'*a*, 14*b*, 14'*b*)are provided.

Furthermore, in the preceding illustrations, the cutouts have the same length "L" and the same width "I", but it could be otherwise, as is schematically shown in FIGS. 13, 14, 15 and 16, which represent four other possible variations. In the two variations of FIGS. 13 and 14, the cutouts (13, 14*a*, 14*b*) have different lengths, whereas in the variations of FIG. 15, it is their widths that are different.

Figure 17:
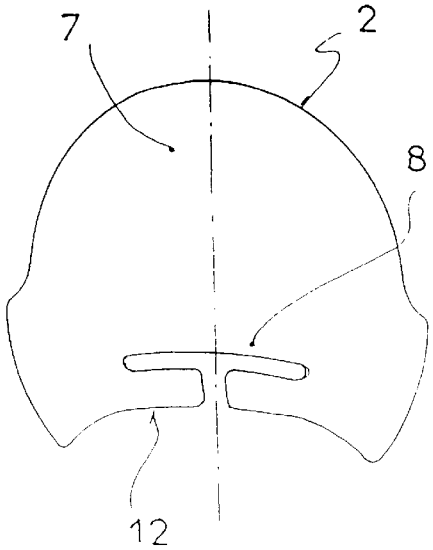
Figure 18:
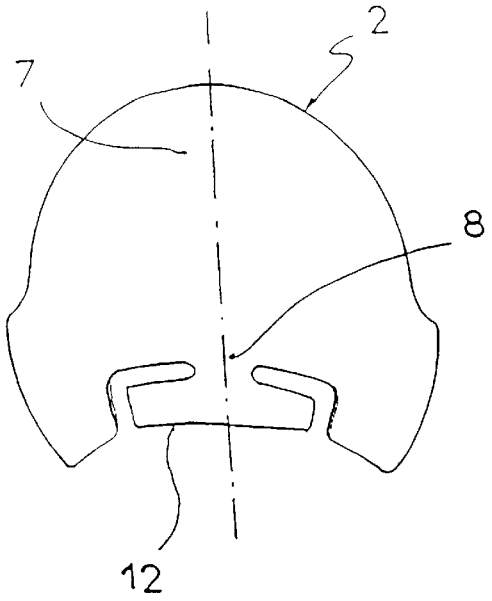

Let's note also that the cutouts (13, 14*a*, 14*b*, 14'*a*, 14'*b*) that open on the lower edge (12) are longitudinal slits extending toward the top of the shell, but it could be otherwise, as is illustrated, for example, in FIGS. 17 and 18, which show two other possible embodiments.

It is understood that the helmet according to the invention can comprise one or more pivoting facial protective screens designated by the reference numeral (50), for example, as illustrated.

FIGS. 19*a* and 19*b* illustrate another alternative embodiment according to which the retention of the nape cushion (17) is constituted by projections (20, 20*a*, 20*b*) that are engaged in corresponding holes (200, 200*a*, 200*b*) made in the wall of the helmet.

Furthermore, let's note that the finishing portion could participate in the retention of the nape cushion (17) by actively retaining the fastening projections (2), 20*a*, 20*b*). Thus, as illustrated in FIG. 20, one can provide retaining projections (220) on the finishing portion (22) that are adapted to hold the cylindrical portion (200) of the fastening projections (20, 20*a*, 20*b*) of the nape cushion (17). FIG. 21 shows a variation according to which the finishing portion includes a peripheral projection (221) adapted to retain the flange (201) of the fastening projections (20, 20*a*, 20*b*) of the nape cushion.

Of course, the invention is not limited to the embodiments described and shown by way of examples, but it also includes all the technical equivalents as well as their combinations.

What is claimed is:

1. A protective helmet including a main outer shell formed by a wall having a front facial opening, said main outer shell includes a plurality of wall portions, namely, an upper front wall portion extended rearwardly by an upper rear wall portion, which is itself extended downwardly by a lower rear wall portion limited downwardly by a lower edge, and wherein the rear lower portion of the wall, which corresponds to the zone occupied by the nape of the user, includes resilient bending means formed unitarily and in one-piece with said main outer shell.

2. A protective helmet according to claim 1, wherein said bending means terminates at a position less than half the height of the helmet.

3. A protective helmet according to claim 2, wherein the wall of the main outer shell is made out of a deformable material.

4. A protective helmet according to claim 3, wherein the wall of the outer shell is made out of a plastic material.

5. A protective helmet according to claim 3, wherein the wall of the outer shell is made out of a composite material.

6. A protective helmet according to claim 5, wherein the composite material is formed of at least one layer of at least one of glass fibers, carbon fibers and aramid fibers impregnated with one of a thermoplastic and a thermohardening resin.

7. A protective helmet according to claim 1, wherein said resilient bending means in said lower rear wall portion includes at least one cutout.

8. A protective helmet according to claim 7, wherein the cutout opens downwardly on the lower edge.

9. A protective helmet according to claim 8, wherein the lower rear wall portion includes two lateral cutouts.

10. A protective helmet according to claim 8, wherein the lower rear wall portion includes three openings or cutouts having the form of open slits on the lower edge, namely, one central cutout and two lateral cutouts which thus form two deformable tongues and two deformable lateral wall pieces.

11. A protective helmet according to claim 9, wherein the three cutouts have the same length.

12. A protective helmet according to claim 10, wherein the central cutout has a different length than the lateral cutouts.

13. A protective helmet according to claim 11, wherein the three cutouts have the same width.

14. A protective helmet according to claim 11, wherein the central cutout has a different width than the lateral cutouts.

15. A protective helmet according to claim 1, wherein said resilient bending means comprises at least one cutout in the rear lower portion to define at least two deformable portions, said at least one cutout extending to a position less than half the height of the helmet; and a nape cushion removably attached to the helmet in the area of the at least one cutout.

16. A protective helmet according to claim 15, wherein said nape cushion extends across the at least one cutout to cover and protect the rear lower portion.

17. A protective helmet of the type including a main outer shell formed by wall having a front facial opening, wherein the rear lower portion of the wall, which corresponds to the zone occupied by the nape of the user, includes resilient bending means, and wherein said bending means includes at least one cutout and said helmet further includes a nape cushion partially held in the shell by said at least one cutout of the wall.

18. A protective helmet according to claim 17, wherein at least one projection affixed to the nape cushion is provided and is adapted to cooperate with at least one of the corresponding cutouts to be held therein.

19. A protective helmet of the type including a main outer shell formed by a wall having a front facial opening, wherein the rear lower portion of the wall, which corresponds to the zone occupied by the nape of the user, includes a resilient bending portion formed unitarily and in one-piece with said main outer shell.

20. A protective helmet according to claim 19, wherein said resilient bending portion comprises at least one cutout in the rear lower portion to define at least two deformable portions, said at least one cutout extending to a position less than half the height of the helmet; and a nape cushion removably attached to the helmet in the area of the at least one cutout.

21. A protective helmet according to claim 20, wherein said nape cushion extends across the at least one cutout to cover and protect the rear lower portion.

22. A protective helmet according to claim 18, wherein said bending portion terminates at a position less than half the height of the helmet.

* * * * *